US010857594B2

(12) United States Patent
Choi et al.

(10) Patent No.: US 10,857,594 B2
(45) Date of Patent: Dec. 8, 2020

(54) METHOD FOR PRODUCING METAL SINTERED BODY

(71) Applicant: SEOUL NATIONAL UNIVERSITY R&DB FOUNDATION, Seoul (KR)

(72) Inventors: Jong Hyun Choi, Seoul (KR); Hyun Min Sung, Seoul (KR); Seong Hyeon Hong, Seoul (KR); Heung Nam Han, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 301 days.

(21) Appl. No.: 15/970,982

(22) Filed: May 4, 2018

(65) Prior Publication Data

US 2018/0326483 A1 Nov. 15, 2018

(30) Foreign Application Priority Data

May 12, 2017 (KR) ..... 10-2017-0059431

(51) Int. Cl.
*B22F 3/105* (2006.01)
*B22F 3/10* (2006.01)

(52) U.S. Cl.
CPC ..... *B22F 3/105* (2013.01); *B22F 3/1017* (2013.01); *B22F 2003/1051* (2013.01); *B22F 2203/11* (2013.01); *B22F 2301/20* (2013.01); *B22F 2998/10* (2013.01)

(58) Field of Classification Search
None
See application file for complete search history.

(56) References Cited

FOREIGN PATENT DOCUMENTS

| | | |
|---|---|---|
| KR | 1020110113213 | 10/2011 |
| KR | 1020120136227 | 12/2012 |
| KR | 1020120136227 A * | 12/2012 |

OTHER PUBLICATIONS

Deng, et al., "Spark plasma sintering of pure tungsten powder: Densification kinetics and grain growth," Jan. 2017, Powder Technology, vol. 310, p. 264-271 (Year: 2017).*
Ren, et al., "The study on low temperature sintering of nano-tungsten powders," Oct. 2016, International Journal of Refractory Metals and Hard Materials, vol. 61, p. 273-278 (Year: 2016).*
Lee, et al., "Densification mechanism and mechanical properties of tungsten powder consolidated by spark plasma sintering," Aug. 2016, vol. 61, p. 22-29 (Year: 2016).*

* cited by examiner

*Primary Examiner* — Colleen P Dunn
*Assistant Examiner* — Dean Mazzola
(74) *Attorney, Agent, or Firm* — Stuart H. Mayer; Mayer & Williams PC

(57) ABSTRACT

Provided is a method for producing a metal sintered body. The method for producing a metal sintered body in accordance with an embodiment includes (a) disposing a metal powder in a chamber of a spark plasma sintering apparatus, (b) applying a electric current to the metal powder to raise a temperature inside the chamber from a standby temperature to a first sintering temperature, (c) lowering the temperature inside the chamber to a second sintering temperature lower than the first sintering temperature and performing sintering, and (d) lowering the temperature inside the chamber from the second sintering temperature to the standby temperature.

6 Claims, 17 Drawing Sheets

(Prior Art)

FIG. 4A
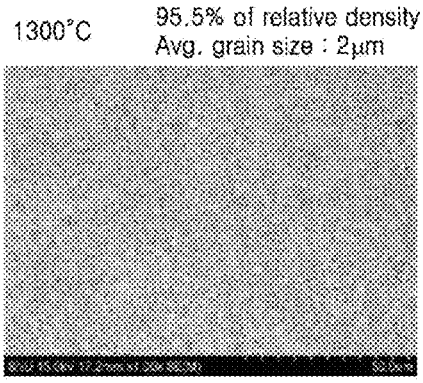
FIG. 4B
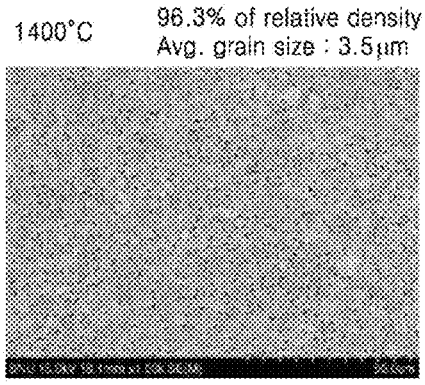
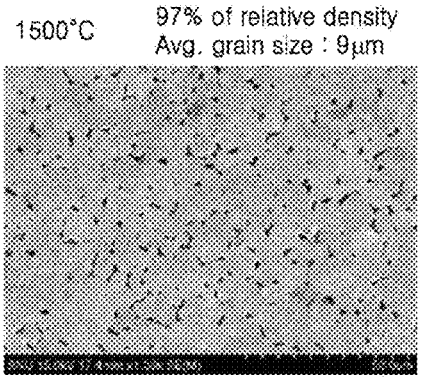
FIG. 4C
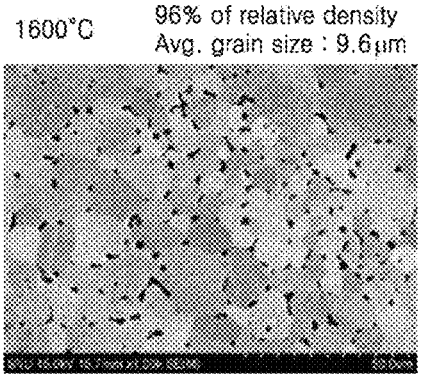
FIG. 4D 5 min of holding time
Avg. grain size : 2μm
96% of relative density 10 min of holding time
Avg. grain size : 9.6μm
95% of relative density Single step sintered at 1600°C
96% of relative density Two step sintered at 1600/1300°C
97.4% of relative density 100°C/min
97.5% of relative density 50°C/min
98.5% of relative density Initial powder
~98% of relative density Reduced powder
99.9% of relative density

FIG. 9

| Sample name | Powder reduction conditions | Sintering conditions (Spark plasma sintering) | Rel. density | Avg. hardness (STD) | Avg. grain size |
|---|---|---|---|---|---|
| SPS-$W_1$ | 100% $H_2$ reduced (900°C 24H) 0.5μm | Two step sintering 1600-1300, 50°C/min 60MPa, 5min | 99.9% | 370HV30 (3) | 2.1 μm |
| SPS-$W_2$ | 100% $H_2$ reduced (1100°C 1H) 0.5μm | | | 359HV30 (6) | 4.0 μm |
| SPS-$W_3$ | | Two step sintering 1700-1400, 100°C/min 60MPa, 5min | | 352HV30 (4) | 4.4 μm |

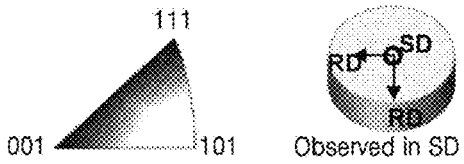
FIG. 10A
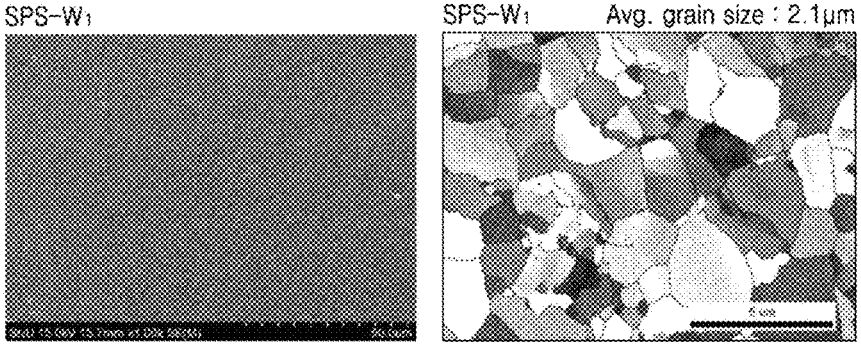
FIG. 10B
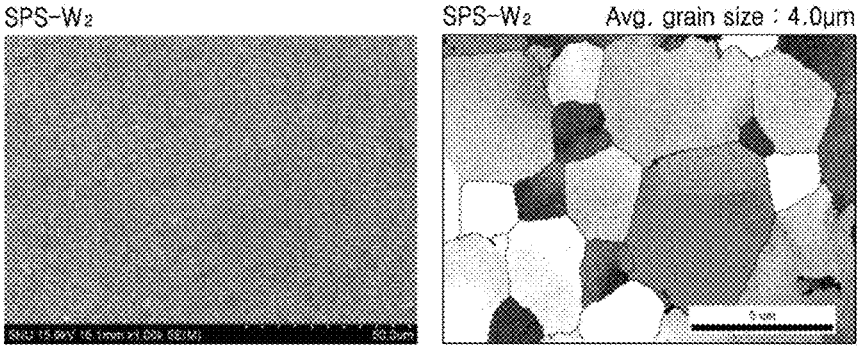
FIG. 10C
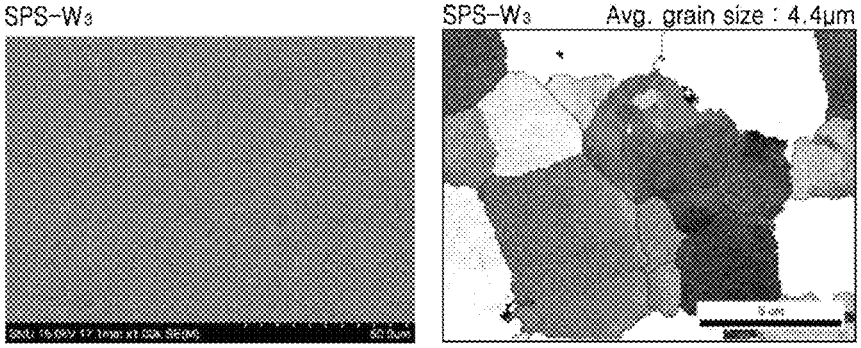

FIG. 13A
Before HHF (Plansee-$W_n$)
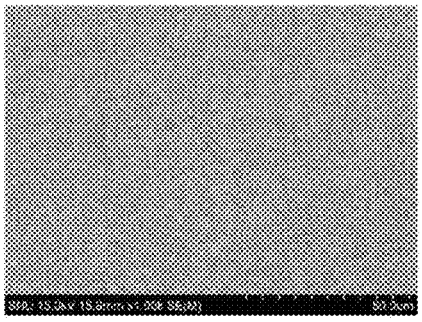
FIG. 13B
After HHF (Plansee-$W_n$)
Increased surface roughness
No severely damaged region
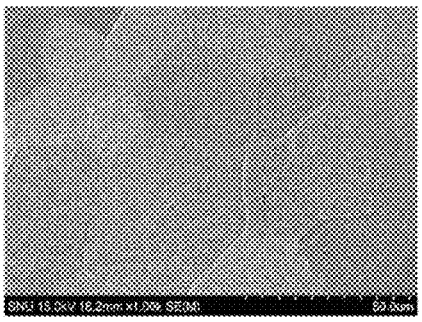
Before HHF (Plansee-$W_p$)
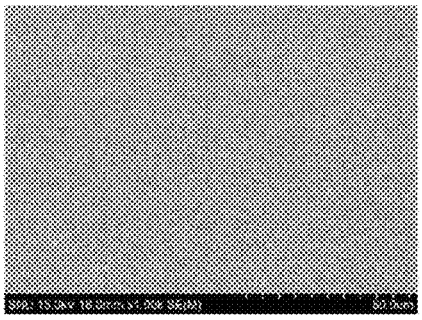
FIG. 13C
After HHF (Plansee-$W_p$)
Increased surface roughness
No severely damaged region
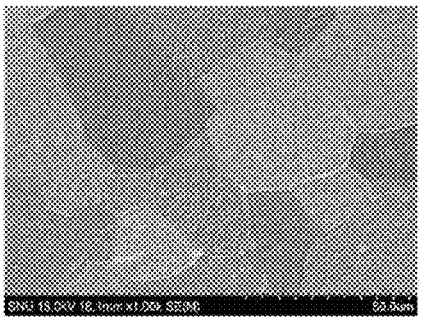
FIG. 13D FIG. 15A
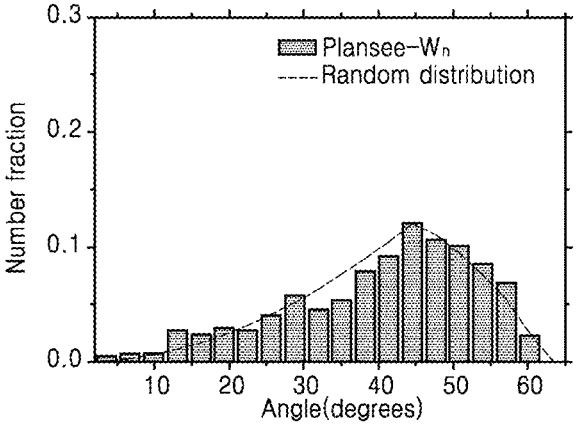
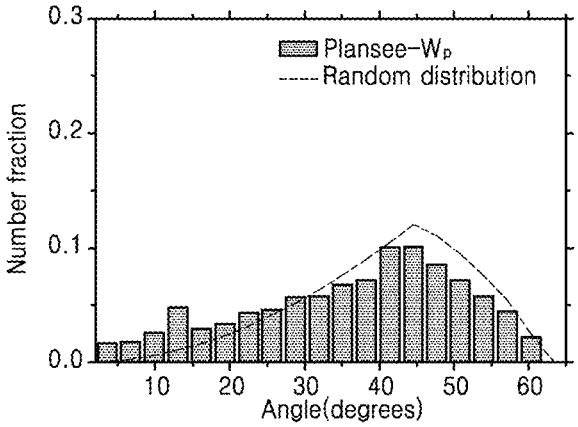
FIG. 15B FIG. 16A
Before HHF (SPS-$W_1$)
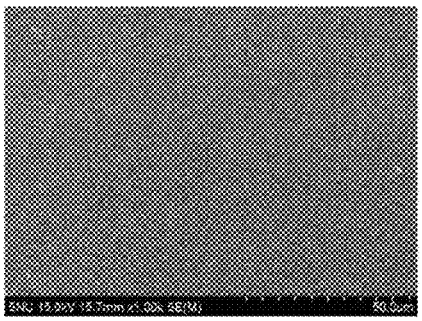
FIG. 16B
After HHF (SPS-$W_1$)
Increased surface roughness
No severely damaged region
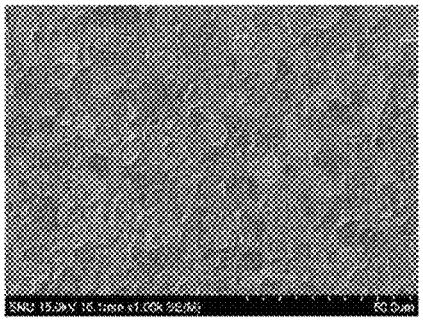
Before HHF (SPS-$W_3$)
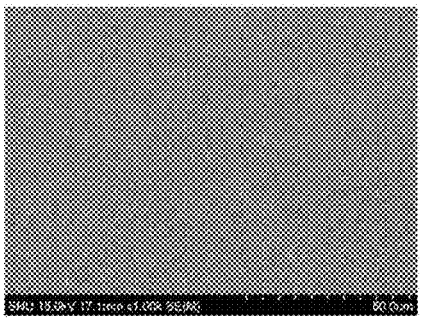
After HHF (SPS-$W_3$)
Increased surface roughness
No severely damaged region
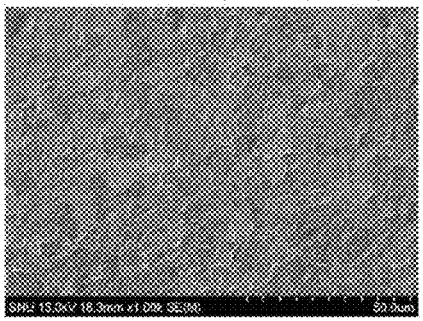
FIG. 16C
FIG. 16D After HHF (SPS-$W_1$)

Avg. grain size : 6.0μm

After HHF (SPS-$W_3$)

Avg. grain size : 6.4μm

Observed in SD

FIG. 18A
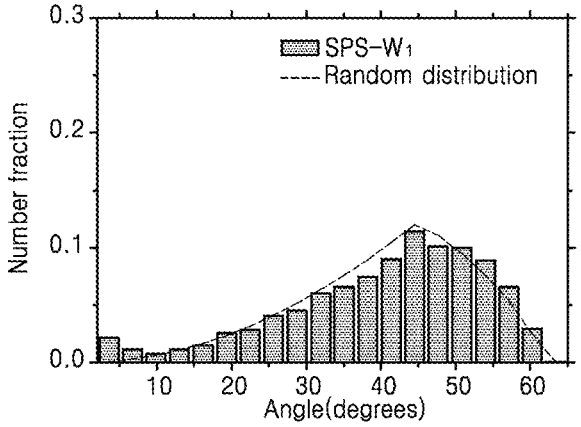
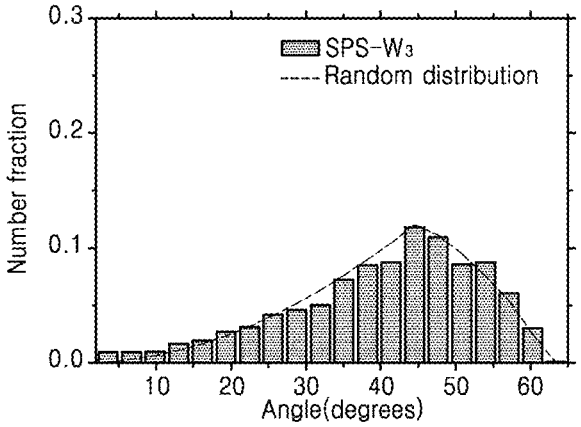
FIG 18B

METHOD FOR PRODUCING METAL SINTERED BODY

CROSS-REFERENCE TO RELATED APPLICATION

This application claims priority to Korean Patent Application No. 10-2017-0059431 filed on May 12, 2017 and all the benefits accruing therefrom under 35 U.S.C. § 119, the contents of which are incorporated by reference in their entirety.

BACKGROUND

The present disclosure relates to a method for producing a sintered body, and more particularly, to a method for producing a metal sintered body having a small grain size and being densified, wherein the method uses a current-applied sintering method and performs a sintering step in the two steps of a first sintering temperature and a second sintering temperature lower than the first sintering temperature.

Sintering is a process for forming a powder into a bulk form through diffusion by using a metal powder at a temperature lower than the melting point of the metal. A typical sintering method produces a metal sintered body having a relative density of about 80 to 90% through atmospheric pressure sintering, pressure sintering and the like. The metal sintered body is processed by a thermomechanical process such as rolling, forging or the like at a high temperature to reduce pores therein, so that the density is improved and the mechanical properties are enhanced. The metal sintered body thus produced may have a relative density of 99% or more.

On the other hand, due to the limitations of fossil fuels and the concern of greenhouse effect, mankind is looking for a safe and clean power source for the next generation, and nuclear fusion electric power is considered strongly. Korea is a member of the international fusion reactor project called the international thermonuclear experimental reactor (ITER) to which the United States, China, and the like belong. As a member, Korea serves to procure various parts such as a reactor's superconductor and a tritium storage system. In spite of Korea' weight, plasma-facing materials (PFMs) have rarely studied. PFMs constituent the first wall and divertor, etc. of a nuclear fusion reactor, and may strongly affect the structural stability of the nuclear fusion reactor and the stability of plasma.

The inside of the nuclear fusion reactor is exposed in severe plasma conditions such as neutrons, ion irradiation, high heat flux, and the like, so that an applicable material is limited, and a carbon material such as graphite has been considered in the past.

SUMMARY

The carbon material has a high melting point, is light, has good thermal conductivity and low irradiation loss, and the like. However, a high erosion rate at a process temperature of the nuclear fusion reactor may cause thermal conductivity to be lowered due to a neutron damage. Therefore, tungsten is considered as the most likely candidate material for PFMs due to physical properties thereof such as high melting point, high thermal conductivity, low tritium retention, and low erosion rate.

Due to the high melting point of tungsten, a structure may generally be produced by sintering treatment. A metal sintered body is produced by sintering and processed by a thermomechanical process such as rolling or forging to decrease pores therein, so that the density thereof may be improved and the mechanical properties thereof may be enhanced. However, the residual stress or the like in a material caused by the thermomechanical process may serve as a driving force which allows the material to be easily corroded or recrystallized to easily lose the physical properties thereof when the material is exposed to extreme environments such as high temperature or chemical environment.

The present disclosure provides a method for producing a metal sintered body of which relative density and mechanical properties are improved The present invention also provides a method for producing a metal sintered body capable of producing a sintered body only by a sintering process without the necessity of performing a thermomechanical process as a subsequent process.

However, these aspects are merely illustrated, but do not limit the scope of the present invention.

In accordance with an embodiment, a method for producing a metal sintered body, the method including: (a) disposing a metal powder in a chamber of a spark plasma sintering apparatus; (b) applying an electric current to the metal powder to raise a temperature inside the chamber from a standby temperature to a first sintering temperature; (c) lowering the temperature inside the chamber to a second sintering temperature lower than the first sintering temperature and performing sintering; and (d) lowering the temperature inside the chamber form the second sintering temperature to the standby temperature.

In addition, in accordance with an embodiment, the metal powder may be a tungsten powder.

In addition, in accordance with an embodiment, the metal powder may have an average particle size of about 0.2 μm to about 20 μm.

In addition, in accordance with an embodiment, the first sintering temperature may be 0.45 $T_m$ to 0.65 $T_m$ based on the melting point ($T_m$) of the metal powder.

In addition, in accordance with an embodiment, the first sintering temperature may be 0.35 $T_m$ to 0.55 $T_m$ based on the melting point ($T_m$) of the metal powder.

In addition, in accordance with an embodiment, in step (b), a heating rate may not exceed 200° C./min.

In addition, in accordance with an embodiment, prior to step (a), the metal powder may be subjected to reduction treatment.

In addition, in accordance with an embodiment, in step (b), a heating rate may be 50° C./min and the first sintering temperature may be 1,600° C., and in step (c), the second sintering temperature may be 1,300° C. and a sintering time may be 5 minutes.

In addition, in accordance with an embodiment, in step (b), a heating rate may be 100° C./min and the first sintering temperature may be 1,700° C., and in step (c), the second sintering temperature may be 1,400° C. and a sintering time may be 5 minutes.

BRIEF DESCRIPTION OF THE DRAWINGS

Embodiments can be understood in more detail from the following description taken in conjunction with the accompanying drawings, in which:

FIGS. 4A, 4B, 4C and 4D are scanning electron microscope (SEM) photographs showing a sintered body structure depending on a sintering temperature according to an embodiment of the present invention;

FIG. 9 is a table showing optimized sintering conditions according to an embodiment of the present invention;

FIGS. 10A, 10B and 10C are scanning electron microscope with electron backscatter diffraction (SEM/EBSD) photographs of sintered body samples SPS-$W_1$, SPS-$W_2$, and SPS-$W_3$ according to an embodiment of the present invention;

FIGS. 13A, 13B, 13C and 13D are SEM/EBSD photographs and misorientation angle profiles showing the evaluation of high heat flux (HHF) characteristics of related art sintered body samples Plansee-$W_p$ and Plansee-$W_n$;

FIGS. 15A and 15B are SEM/EBSD photographs and misorientation angle profiles showing the evaluation of high heat flux (HHF) characteristics of related art sintered body samples Plansee-$W_p$ and Plansee-$W_n$;

FIGS. 16A, 16B, 16C and 16D are SEM/EBSD photographs and misorientation angle profiles showing the evaluation of high heat flux (HHF) characteristics of sintered body samples SPS-$W_1$ and SPS-$W_3$ according to an embodiment of the present invention.

FIGS. 18A and 18B are SEM/EBSD photographs and misorientation angle profiles showing the evaluation of high heat flux (HHF) characteristics of sintered body samples SPS-$W_1$ and SPS-$W_3$ according to an embodiment of the present invention.

DETAILED DESCRIPTION OF EMBODIMENTS

Figure 1:
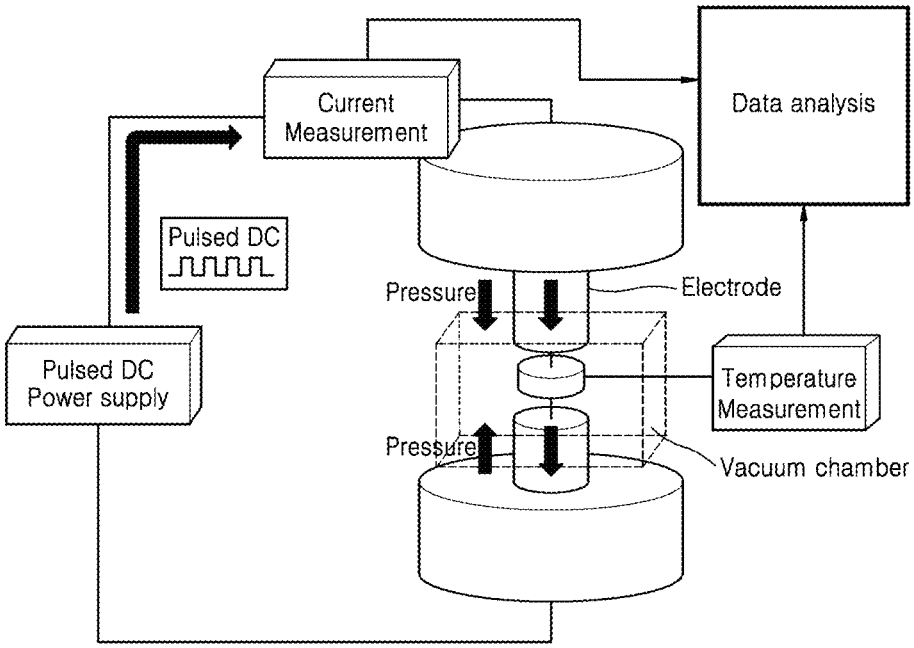
FIG. 1 is a schematic view illustrating a spark plasma sintering, according to an embodiment of the present invention.

Hereinafter, specific embodiments will be described in detail with reference to the accompanying drawings.

The following detailed description of the invention refers to the accompanying drawings, which illustrate, by way of illustration, specific embodiments in which the invention may be practiced. These embodiments are described in sufficient detail to enable those skilled in the art to practice the invention. It should be understood that the various embodiments of the present invention are different, but need not be mutually exclusive. For example, certain features, structures, and characteristics described herein may be implemented in other embodiments without departing from the spirit and scope of the invention in connection with one embodiment. It is also to be understood that the position or arrangement of the individual components within each disclosed embodiment may be varied without departing from the spirit and scope of the invention. The following detailed description is, therefore, not to be taken in a limiting sense, and the scope of the present invention is to be limited only by the appended claims, along with the full scope of equivalents to which such claims are entitled, if properly explained. In the drawings, like reference numerals refer to the same or similar functions throughout the several views, and the length, area, thickness, and the like may be exaggerated for convenience.

Hereinafter, preferred embodiments of the present invention will be described in detail with reference to the accompanying drawings, so that those skilled in the art can easily carry out the present invention.

Two Step Sintering (TSS)

Figure 2A:
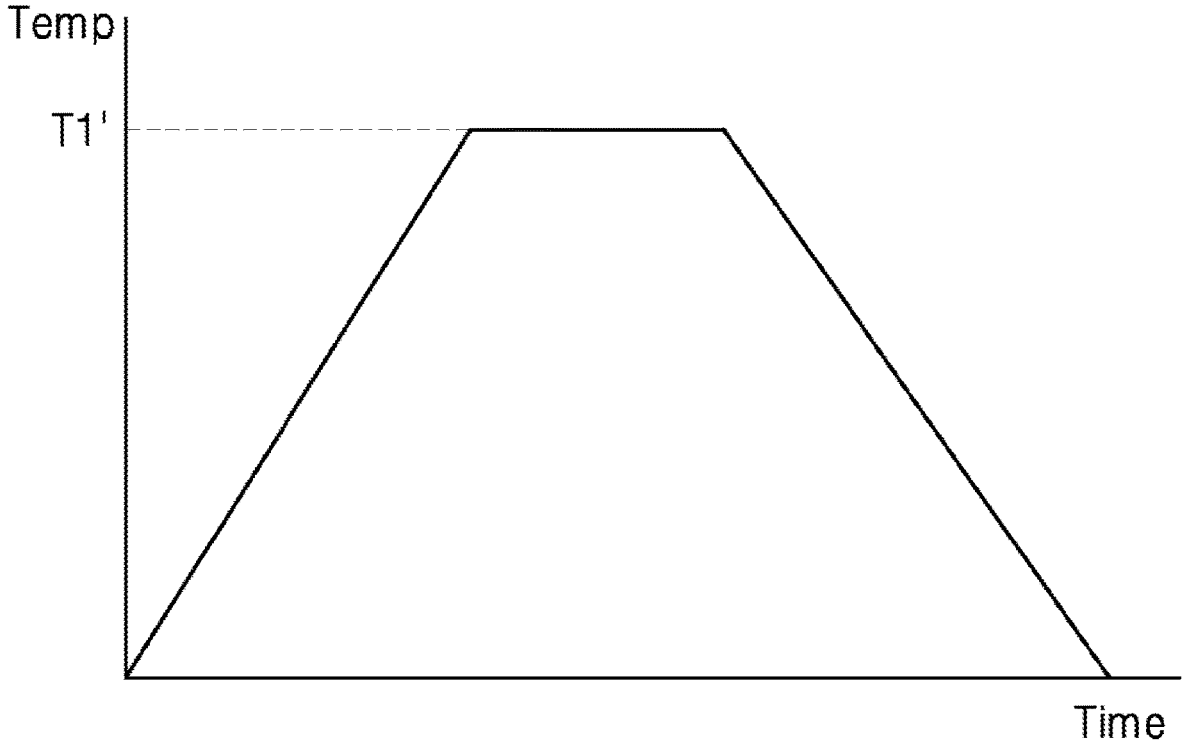
FIG. 2A is a graph illustrating a related art sintering temperature control.
Figure 2B:
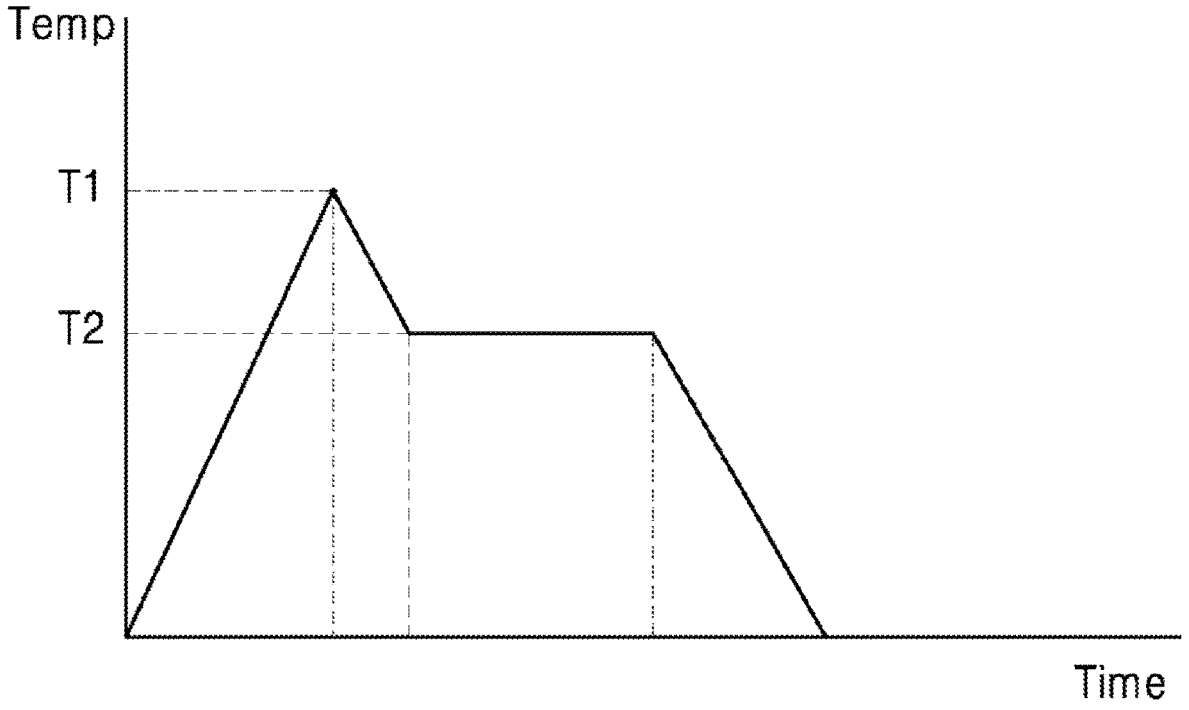
FIG. 2B is a graph illustrating a sintering temperature control in current-applied sintering according to an embodiment of the present invention.

FIG. 1 is a schematic view illustrating a spark plasma sintering (SPS) apparatus according to an embodiment of the present invention. FIG. 2A illustrates a graph showing a related art sintering temperature control, and FIG. 2B illustrates a graph showing a sintering temperature control in a current-applied sintering according to an embodiment of the present invention.

A method for producing a metal sintered body includes (a) disposing a metal powder inside a chamber of a spark plasma sintering apparatus, (b) applying an electric current to the metal powder to raise a temperature inside the chamber from a standby temperature to a first sintering temperature, (c) lowering the temperature inside the chamber to a second sintering temperature lower than the first sintering temperature, and performing sintering, and (d) lowering the temperature inside the chamber from the second sintering temperature to the standby temperature. In the present specification, the process for performing sintering through the first sintering temperature and the second sintering temperature is also referred to as a two step sintering (TSS).

The spark plasma sintering (SPS) process is a sintering process in which electricity is directly applied to a mold including a powder to utilize a current effect, that is, an acceleration effect of diffusion by an electric current. The mechanism of the current effect has not been clearly clarified, but has a faster heating rate and cooling rate than a related art sintering method, and has a high sintering efficiency. The related art sintering method is performed so as to have a relative density of about 80% at a high temperature higher than 2,200° C., and improves the relative density by further performing a thermomechanical process such as rolling or forging. On the other hand, the spark plasma sintering method has a merit that a relative density of 99.9% may be realized without the thermomechanical process, and high density sintering may be performed at a low temperature.

First, referring to FIG. 1, a metal powder is disposed in a chamber (or mold), and sufficient pressure is applied to the metal powder for sintering. In order to further reduce the pores between crystal grains after the completion of sintering, the atmosphere in the chamber is preferably in vacuum. Electrodes may be connected to both ends of the mold, thus directly applying an electric current to the metal powder.

According to one embodiment, a graphite mold has an inner diameter of 10.5 mm, an outer diameter of 20 mm and a height of 40 mm, and a graphite electrode may be formed so as to have a 10 mm diameter and a 30 mm height. In order to prevent carburization of a sintered material during sintering, a 0.5 mm thick carbon sheet may be wrapped in the inner diameter of the graphite mold such that the powder and the mold are not in contact. A sintering temperature may be measured by a two-channel pyrometer.

Referring to FIG. 2A, the related art sintering method performs a single step sintering process. A typical single step sintering process is composed of the processes of heating (sintering temperature ($T_1$'))→maintaining (sintering temperature ($T_1$'))→cooling (standby temperature).

Referring to FIG. 2B, the two step sintering (TSS) according to an embodiment of the present invention may be composed of the processes of heating (first sintering temperature ($T_1$))→rapid cooling (second sintering temperature ($T_2$))→maintaining (second sintering temperature ($T_2$)) →cooling (standby temperature).

In one embodiment of the present invention, the metal powder may be a tungsten powder. Tungsten has a high melting point ($T_m$) of about 3,700 K, the lowest vapor pressure ($1.3\times10^{-7}$ Pa at $T_m$), and the sixth highest thermal conductivity. In addition, tungsten has high threshold energy to resist sputtering, low tritium retention, low erosion rate, and high thermal stability.

The metal powder may be a powder having an average particle size of about 0.2 μm to about 20 μm with few impurities.

Secondly, electric current may be applied into the chamber of the spark plasma sintering apparatus to raise the temperature from the standby temperature inside the chamber to the first sintering temperature ($T_1$).

The first sintering temperature ($T_1$) may be 0.45 $T_m$ to 0.65 $T_m$ based on the melting point ($T_m$) of the metal powder The heating may be performed rapidly to the first sintering temperature ($T_1$), and may be performed at a rate not exceeding 200° C./min. The spark plasma sintering (SPS) process described above is preferable for rapid heating.

Thirdly, the electric current may be blocked from being applied into the chamber of the spark plasma sintering apparatus to lower the temperature inside the chamber up to the second sintering temperature ($T_2$) lower than the first sintering temperature ($T_1$). In the spark plasma sintering (SPS), there is an advantage that the cooling may be performed rapidly by merely applying no current.

The second sintering temperature ($T_2$) may be 0.35 $T_m$ to 0.55 $T_m$ based on the melting point ($T_m$) of the metal powder in a range lower than the first sintering temperature ($T_1$).

Fourthly, sintering is performed by maintaining the second sintering temperature ($T_2$), and the sintering may be completed and then cooled to the standby temperature.

When sintering is performed at the second sintering temperature ($T_2$), the growth of crystal grains between powders is suppressed, and densification may be achieved. Here, the densification means that the pores between crystal grains are removed and relative density increases. Densification may be achieved by accelerating the diffusion by uniformly applying the electric current to the whole powder in the spark plasma sintering (SPS) process.

In the related art single step sintering process as shown in FIG. 2A, sintering is performed at a temperature equal to or higher than the first sintering temperature ($T_1$). In this process, the pores decrease and the crystal grains grow simultaneously. The grain growth causes the pores to be trapped inside the crystal grain, so that the pores may not be decreased smoothly. Due to this, the metal sintered body has a relative density of about 80%, and a thermomechanical process such as forging, rolling, or the like is followed.

In contrast, in the two step sintering (TSS) of the present invention, powders are bonded to each other at the first sintering temperature ($T_1$), and densification is achieved at the second sintering temperature ($T_2$) lower than the first sintering temperature ($T_1$), so that the growth of crystal grains may be suppressed and the pores may be removed. Therefore, the metal sintered body having a relative density of 99.9% may be produced without the necessity of performing a separate thermomechanical process.

Hereinafter, the characteristics of the sintered body will be examined by controlling various elements according to various experimental examples.

Particle Size Control

Figure 3A:
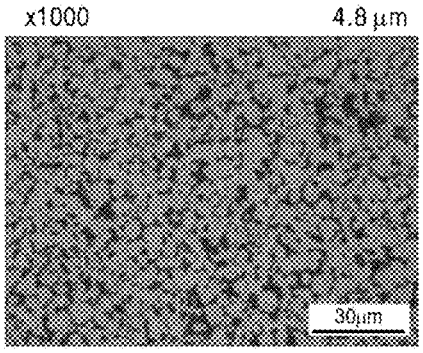
FIGS. 3A, 3B and 3C are optical microscope photographs showing a sintered body structure depending on a powder particle size according to an embodiment of the present invention.
Figure 3B:
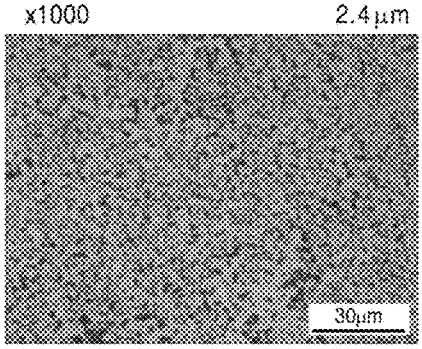
Figure 3C:
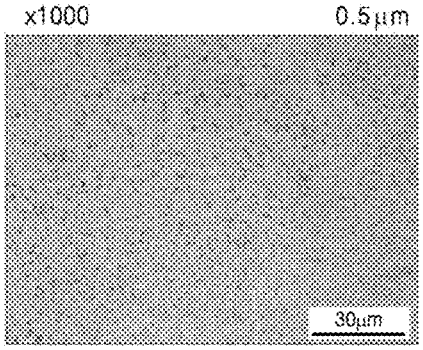

FIG. 3 is optical microscope photographs showing a sintered body structure depending on the particle size of a powder according to an embodiment of the present invention.

In order to examine an effect depending on the particle size, a tungsten powders having average particle sizes of 4.8 μm, 2.4 μm and 0.5 μm were used. The single step sintering process was applied to each of the tungsten powders for 5 minutes at 1500° C., at a heating rate of 100° C./min under a pressure of 25 MPa.

Referring to FIG. 3, it may be seen that the larger the particle size is, the larger the size of the pores (the area darkened in FIG. 3) is. Therefore, it is assumed that a tungsten powder of 0.5 μm, which is the smallest commercially available average particle size, is preferable for decreasing the pore size and increasing the relative density.

Sintering Temperature Control

FIG. 4 is scanning electron microscope with electron backscatter diffraction (SEM/EBSD) photographs showing a sintered body structure depending on a sintering temperature according to an embodiment of the present invention.

In order to examine an effect depending on the sintering temperature, sintering temperatures of 1,300° C., 1,400° C., 1,500° C., and 1,600° C. were applied, respectively. A single step sintering process was applied for 10 minutes at each of the sintering temperatures, under a pressure of 35 MPa at a heating rate of 100° C./min.

Referring to FIG. 4, the relative densities were 95.5%, 96.3%, 97% and 96% at sintering temperatures of 1,300° C., 1,400° C., 1,500° C., and 1,600° C., respectively. The average grain sizes were 2 μm, 3.5 μm, 9 μm, and 9.6 μm, respectively. The average grain sizes were increased with increasing sintering temperature. However, the relative density was not necessarily proportion to the sintering temperature, and it suggests that an optimal sintering temperature is necessary to be specified for obtaining high relative density.

Sintering Time Control

Figure 5A:
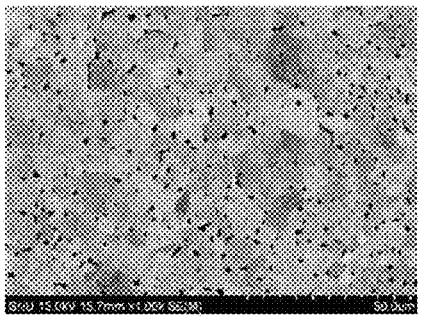
FIGS. 5A and 5B are SEM photographs showing a sintered body structure depending on a sintering time according to an embodiment of the present invention.
Figure 5B:
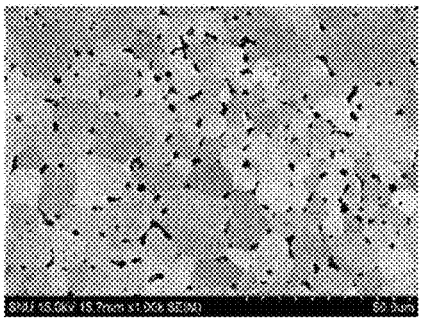

FIG. 5 is SEM/EBSD photographs showing a sintered body structure depending on sintering time according to an embodiment of the present invention.

In order to examine the effect of the sintering time, sintering time of 5 minutes and 10 minutes was applied, respectively. In each sintering time, a single step sintering process was applied at 1,600° C., under a pressure of 35 MPa at a heating rate of 100° C./min. The average grain sizes were 5.3 μm and 9.6 μm, respectively. The relative densities were 96% and 95%, respectively, and the relative density was not largely affected even by lengthening sintering time. Therefore, it is assumed that a sintering time of 5 minutes is sufficient for densification and control of a microstructure.

Sintering Step Control

Figure 6A:
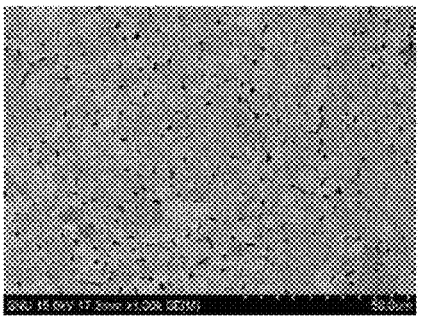
FIGS. 6A and 6B are SEM photographs showing a sintered body structure depending on a sintering step according to an embodiment of the present invention.
Figure 6B:
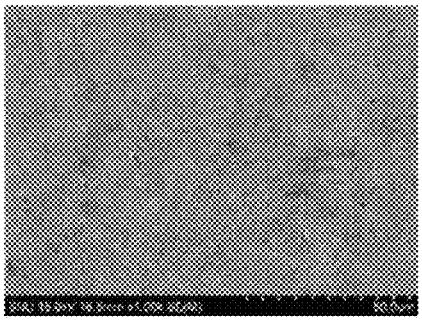

FIG. 6 is SEM/EBSD photographs showing a sintered body structure depending on sintering steps according to an embodiment of the present invention.

In order to examine the effects of sintering steps, single step sintering and two step sintering (TSS) were each performed as described in FIG. 2A and FIG. 2B. The two step sintering (TSS) realizes rapid heating and cooling rates by using spark plasma sintering (SPS), thereby being performed at two sintering temperatures of first and second sintering temperatures ($T_1$, $T_2$). Large pores are removed at the first sintering temperature ($T_1$) of the two step sintering (TSS), and a neck is formed between the metal powders. At the second sintering temperature ($T_2$), crystal grains may be prevented from coarsening and the density may be increased.

A sintering temperature ($T_1$') of 1,600° C. in the single step sintering, and a first sintering temperature ($T_1$) of 1,600° C. and a second sintering temperature ($T_2$) of 1,300° C. in the two step sintering (TSS) are applied. The time interval between the first sintering temperature ($T_1$) and the second sintering temperature ($T_2$) is 10 seconds, and the sintering time is counted when the second sintering temperature ($T_2$) is reached. The heating rate to the first sintering temperature ($T_1$) is 100° C./min, and the sintering time is 5 minutes.

Referring to the microstructure of FIG. 6. it may be seen that the pore on the surface of sintered tungsten is sharply decreased in the two step sintering (TSS). The average grain sizes are 5.3 μm and 3.6 μm, respectively. Also, the relative densities are 96% and 97.4%, respectively. This is because the growth of crystal grain is delayed in the two step sintering (TSS) and the densification is occurred. As a result, it may be ascertained that the two step sintering (TSS) is advantageous for producing high density sintered tungsten having a smaller average grain size.

Heating Rate Control

Figure 7A:
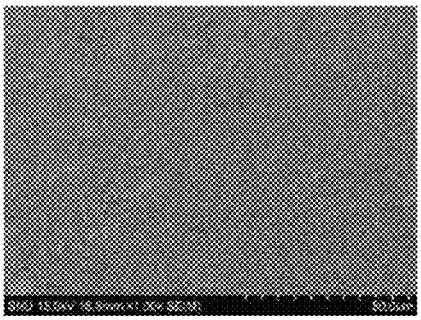
FIGS. 7A and 7B are SEM photographs showing a sintered body structure depending on a heating rate according to an embodiment of the present invention.
Figure 7B:
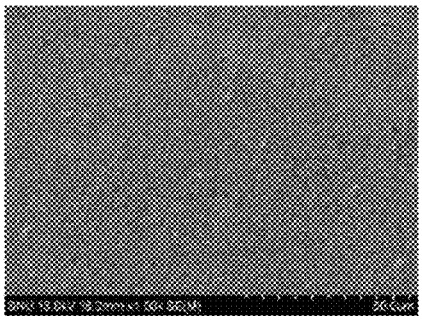

FIG. 7 is SEM/EBSD photographs showing a sintered body structure depending on a heating rate according to an embodiment of the present invention.

The heating rate to the first sintering temperature ($T_1$) in the two step sintering (TSS) was applied to 100° C./min and 50° C./min, respectively. Referring to FIG. 7, there was no significant difference, but there was a slight difference in relative density depending on the heating rate. Relative densities were 97.5% and 98.5%, respectively, and it is ascertained that a heating rate of 50° C./min was more desirable.

Reduction Treatment

Figure 8A:
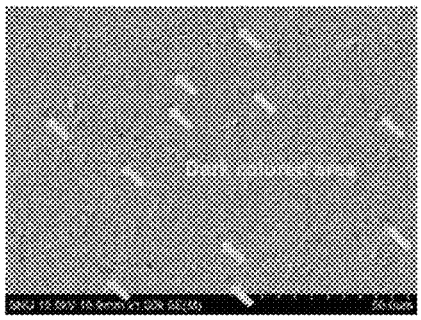
FIGS. 8A and 8B is SEM photographs depending on whether or not the reduction treatment is performed according to an embodiment of the present invention.
Figure 8B:
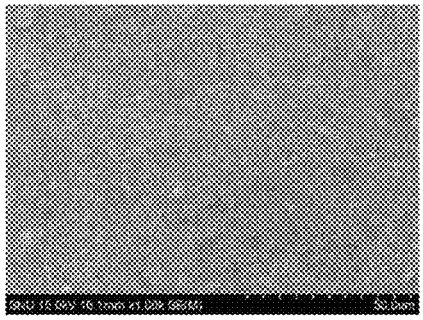

FIG. 8 is SEM/EBSD photographs showing a sintered body structure depending on whether or not reduction treatment is performed according to an embodiment of the present invention.

A tungsten powder may be easily oxidized, so that the effect depending on whether or not the powder was reduced was examined. The two step sintering (TSS) was performed with the powder in the raw material state and the powder after the reduction treatment, respectively. The reduction treatment was performed at 1,300° C. for 2 hours in 5% $H_2$ and 95% Ar atmosphere. The sintering process was performed with an average particle diameter of 0.5 μm, and was performed at a first sintering temperature ($T_1$) of 1,700° C. and a second sintering temperature ($T_2$) of 1,400° C. for 10 minutes and at a heating rate of 100° C./min under a pressure of 60 MPa.

The relative densities before and after the reduction treatment were 97.3% and 99.5%, respectively, and the average grain sizes were 17.4 μm and 5.5 μm, respectively. Also, in (b) of FIG. 8 after completion of the reduction treatment, a portion with a large oxygen content (dark display) was not observed. As a result, the tungsten powder sintered body after the reduction treatment has a small grain size and a high relative density. It is expected that the reduction treatment in 100% $H_2$ atmosphere rather than 5% $H_2$ and 95% Ar atmosphere may further decrease the oxygen content.

Optimized Sintering Condition Calculation

Figure 11A:
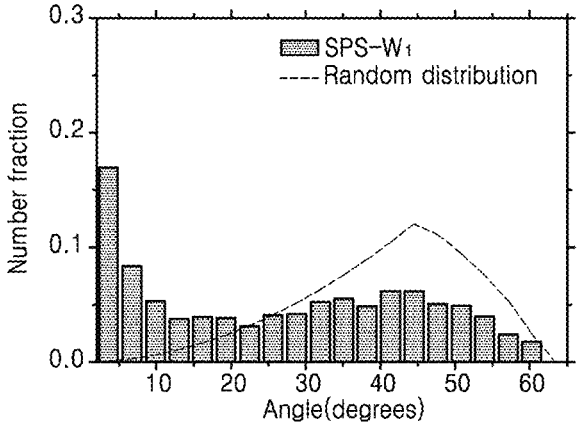
FIGS. 11A, 11B and 11C are misorientation angle profiles of sintered body samples SPS-$W_1$, SPS-$W_2$, and SPS-$W_3$ according to an embodiment of the present invention.
Figure 11B:
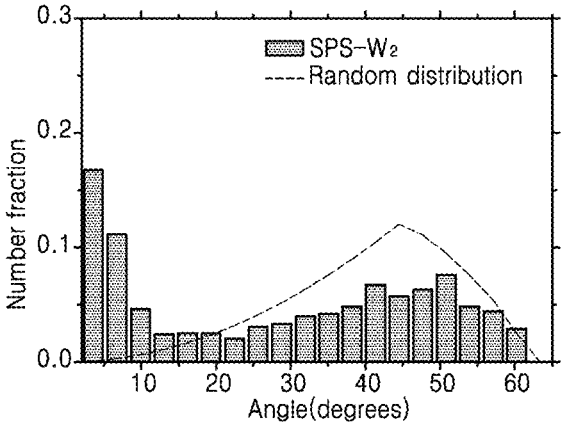
Figure 11C:
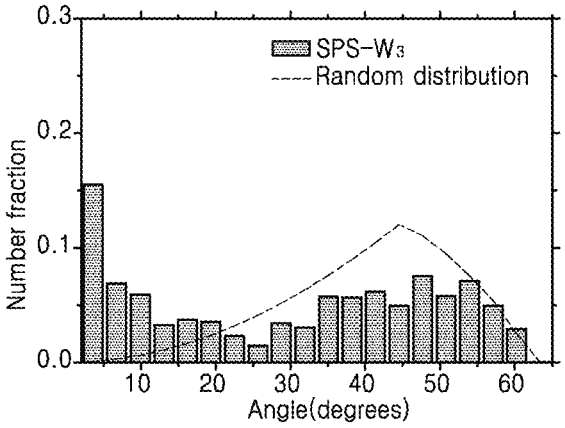

FIG. 9 is a table showing optimized sintering conditions according to an embodiment of the present invention. FIG. 10 is scanning electron microscope with electron backscatter diffraction (SEM/EBSD) photographs of sintered body samples SPS-$W_1$, SPS-$W_2$ and SPS-$W_3$ according to an embodiment of the present invention. FIG. 11 shows misorientation angle profiles of sintered body samples SPS-$W_1$, SPS-$W_2$ and SPS-$W_3$ according to an embodiment of the present invention.

Based on the conditions examined above, optimized densification conditions for producing a metal sintered body having a relative density of 99.9% are calculated.

First, there was used a tungsten powder having an average particle diameter of 0.5 μm in which the reduction treatment had been performed at 900° C. for 24 hours in 100% $H_2$ atmosphere or at 1,100° C. for 1 hour in 100% $H_2$ atmosphere. Also, in the two step sintering (TSS), sintering was performed at a first sintering temperature ($T_1$) of 1,700° C. and a second sintering temperature ($T_2$) of 1,400° C. and at a heating rate of 100° C./min under a pressure of 60 MPa for 5 minutes, and in the two step sintering (TSS) under different conditions, sintering was performed at a first sintering temperature ($T_1$) of 1,600° C. and a second sintering temperature ($T_2$) of 1,300° C. and at a heating rate of 50° C./min under a pressure of 60 MPa for 5 minutes.

Sintered body samples SPS-$W_1$, SPS-$W_2$ and SPS-$W_3$ showed almost no pores, and all had a relative density of 99.9% and exhibited an average grain size of about 2.0 μm to 4.0 μm. Referring to FIG. 11, it may be ascertained that grain boundaries follows a random distribution. Each sintered body sample exhibits a hardness of about 350 to 370 HV30.

Evaluation of Characteristics at High Heat Flux (HHF)

Consideration the use of a sintered body as the inner wall of a nuclear fusion reactor, the properties thereof was evaluated in a high heat flux (HHF) atmosphere. Although the related art sintered body samples Plansee-$W_p$ and Plansee-$W_n$ used as ITER grades were prepared and the two step sintering (TSS) of the present invention was performed, the sintered body sample SPS-$W_{nfs}$ having a relative density of 98% in which densification (relative density of 99.9%) was not completely performed and the sintered body samples SPS-$W_1$, SPS-$W_2$ and SPS-$W_3$ as described in FIG. 9 were prepared.

The test was performed at a high temperature of 2,300° C. and 1,400° C. 2,300° C. was achieved at a heat flux of about 4 MW/$m^2$, and 1,400° C. was realized at a heat flux of about 3 MW/$m^2$. SPS-$W_3$ and Plansee-$W_n$ were tested at both 2,300° C. and 1,400° C., and SPS-$W_1$, SPS-$W_{nfs}$, and Plansee-$W_p$ were tested at 2,300° C. The surface structure, grain size and misorientation angle distribution were observed through SEM/EBSD photographs, and the hardness was measured through Vickers hardness test.

Figure 12A:
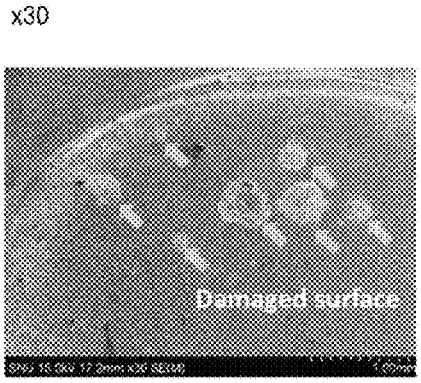
FIGS. 12A and 12B are SEM photographs showing the evaluation of high heat flux (HHF) characteristics of a sintered body sample SPS-$W_{nfs}$ according to an embodiment of the present invention.
Figure 12B:
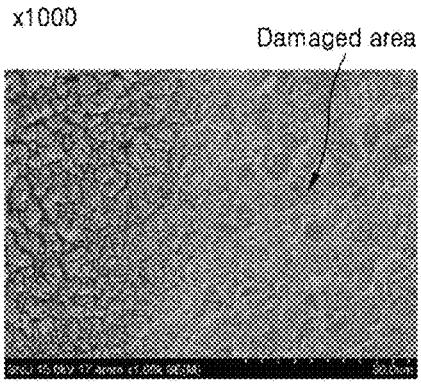

FIG. 12 is SEM photographs showing the evaluation of high heat flux (HHF) characteristics of a sintered body sample SPS-$W_{nfs}$ according to an embodiment of the present invention.

Referring to FIG. 12, many severe damaged areas were observed on the surface. The fact that was not sintered completely to a relative density of 98% means that the pore fraction in the sintered material is high. It is considered that this causes the thermal conductivity of the surface to be lowered and heat is concentrated on a specific portion of the surface, so that the surface is partially melted to be damaged.

Figure 14A:
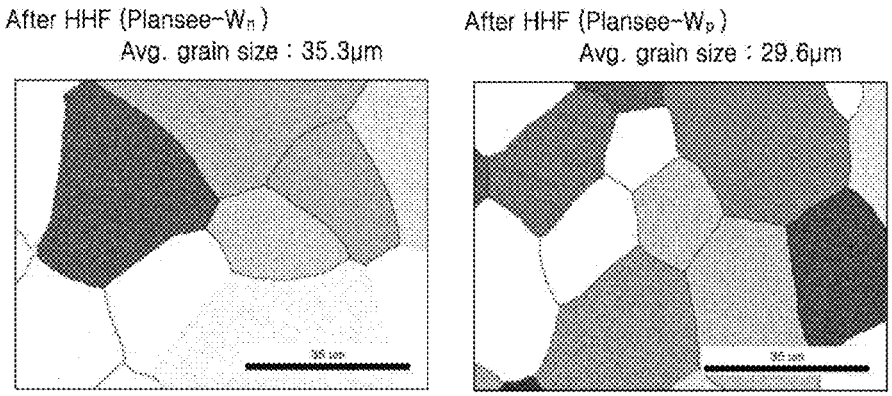
FIGS. 14 A and 14B are SEM/EBSD photographs and misorientation angle profiles showing the evaluation of high heat flux (HHF) characteristics of related art sintered body samples Plansee-$W_p$ and Plansee-$W_n$.
Figure 14B:
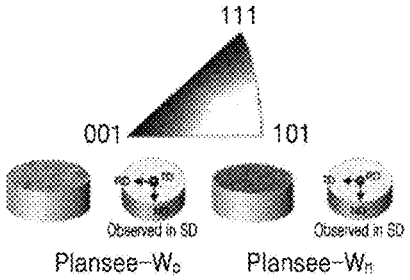
Figure 17A:
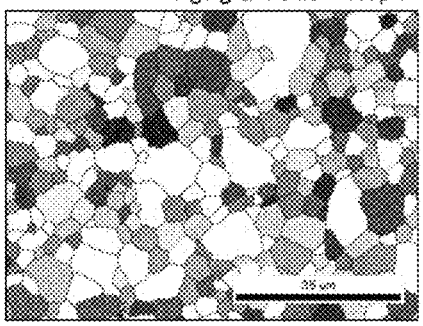
FIGS. 17A and 17B are SEM/EBSD photographs and misorientation angle profiles showing the evaluation of high heat flux (HHF) characteristics of sintered body samples SPS-$W_1$ and SPS-$W_3$ according to an embodiment of the present invention.
Figure 17B:
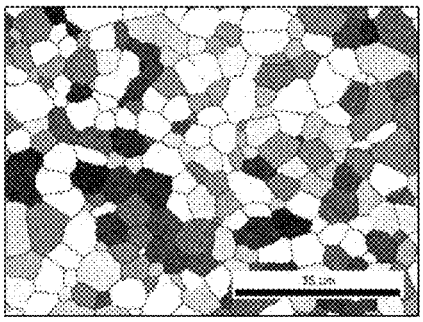
Figure 17B:
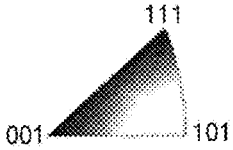
Figure 17B:
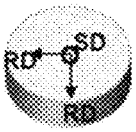

FIGS. 13 to 15 show SEM/EBSD photographs and misorientation angle profiles showing the evaluation of high heat flux (HHF) characteristics of related art sintered body samples Plansee-$W_p$ and Plansee-$W_n$.

Referring to FIG. 13, it may be seen that the surface roughness increases after the test at 2,300° C. and no damaged area appears. The increase in surface roughness appears to be derived from the grain boundary grooving of the tungsten powder.

Referring to FIG. 14, it may be seen that the average grain sizes before and after the HHF test of Plansee-$W_n$ were 4.2 μm and 35.3 μm, respectively, and the crystal grains were grown about 9 times after the HHF test. It may be seen that the average grain sizes before and after the HHF test of Plansee-$W_p$ were 13.3 μm and 29.6 μm, respectively, and the crystal grains were grown about 2 times after the HHF test.

Referring to FIG. 15, it may be seen that the misorientation angle distribution follows a random distribution well, so that both of the two sintered body samples were recrystallized. Even in the hardness test, it may be seen that the hardness before and after the HHF test was 390 HV30 and 303-316 HV30, respectively, and the hardness was lowered more than about 70 HV. This supports that the sintered samples were recrystallized.

FIGS. 16 to 18 show SEM/EBSD photographs and misorientation angle profiles showing the evaluation of high heat flux (HHF) characteristics of sintered body samples SPS-$W_1$ and SPS-$W_3$ according to an embodiment of the present invention.

Referring to FIG. 16, as in FIG. 13, it may be seen that the surface roughness increases after the test at 2,300° C., and no damaged area appears.

Referring to FIG. 17, it may be seen that both of the crystal grains of SPC-$W_1$ and SPS-$W_3$ grew. It may be seen that the average grain sizes of SPS-$W_1$ and SPS-$W_3$ before the HHF test were 2.1 μm and 4.4 μm, respectively, the average grain sizes after the HHF test were 6.0 μm and 6.4 μm, respectively, and the crystal grain was grown about 2 to 3 times.

Referring to FIG. 18, it may be seen that as the misorientation angle distribution followed the random distribution well, both of the two sintered body samples were recrystallized. Even in the hardness test, SPS-W samples showed more stable mechanical properties than Plansee-W samples. It may be seen that before the HHF test, the hardness of SPS-$W_1$ and SPS-$W_3$ was 370 HV30 and 352 HV30, respectively, the hardness after the HHF test was 326-330 HV30, and the hardness was lowered by about 30 to 40 HV.

As a result of the HHF test, it may be seen that SPS-W and SPS-$W_3$ have more stable microstructures at a high temperature than Plansee-$W_p$ and Plansee-$W_n$. The results of thermal stability of SPS-W appear to be derived from the two step sintering (TSS) in the production method. In related art sintered bodies such as Plansee-$W_p$ and Plansee-$W_n$, the residual stress in the material caused by the thermomechanical process may serve as a driving force which the sintered body causes the mechanical properties to lose in exposure to the extreme environment. The sintered body of the present invention produced only by the two step sintering (TSS) without the thermomechanical process has not the residual stress or the like in the material generated from the thermomechanical process, so that it is advantageous in terms of thermal stability.

According to an embodiment of the present invention formed as described above, there is an effect that relative density and mechanical properties may be improved.

Also, according to an embodiment of the present invention, there is an effect that a sintered body may be produced only by a sintering process without the necessity of performing a thermomechanical process as subsequent process.

Of course, the scope of the present invention is not limited by such an effect.

Although the present invention has been described with reference to the specific embodiments, it is not limited thereto. Therefore, it will be readily understood by those skilled in the art that various modifications and changes can be made thereto without departing from the spirit and scope of the present invention defined by the appended claims.

What is claimed is:

1. A method for producing a metal sintered body, the method comprising:

(a) disposing a tungsten powder inside a chamber of a spark plasma sintering apparatus;

(b) applying an electric current to the tungsten powder to raise a temperature inside the chamber from a standby temperature to a first sintering temperature;

(c) lowering the temperature inside the chamber to a second sintering temperature lower than the first sintering temperature and performing sintering; and (d) lowering the temperature inside the chamber from the second sintering temperature to the standby temperature, wherein the first sintering temperature is 0.45 Tm to 0.65 Tm where Tm represents the melting point of the tungsten powder, wherein the second sintering temperature is 0.35 Tm to 0.55 Tm where Tm represents the melting point of the tungsten powder.

2. The method of claim 1, wherein the tungsten powder has an average particle size of about 0.2 μm to about 20 μm.

3. The method of claim 1, wherein in step (b), a heating rate does not exceed 200° C./min.

4. The method of claim 1, wherein prior to step (a), the tungsten powder is subjected to reduction treatment.

5. The method of claim 1, wherein in step (b), a heating rate is 50° C./min and the first sintering temperature is 1,600° C., and in step (c), the second sintering temperature is 1,300° C. and a sintering time is 5 minutes.

6. The method of claim 1, wherein in step (b), a heating rate is 100° C./min and the first sintering temperature is 1,700° C., and in step (c), the second sintering temperature is 1,400° C. and a sintering time is 5 minutes.

* * * * *